US005244643A

United States Patent [19]

Verachtert

[11] Patent Number: 5,244,643

[45] Date of Patent: Sep. 14, 1993

[54] TREATMENT OF OXYGEN CONTAINING GASEOUS HYDROCARBONS FOR MERCAPTAN REMOVAL

[75] Inventor: Thomas A. Verachtert, Wheeling, Ill.

[73] Assignee: UOP, Des Plaines, Ill.

[21] Appl. No.: 839,839

[22] Filed: Feb. 21, 1992

[51] Int. Cl.[5] ..... C01B 17/00; C01B 17/20; C10G 19/00

[52] U.S. Cl. ..... 423/243.08; 423/243.01; 423/243.02; 208/206

[58] Field of Search ..... 423/243.02, 243.01, 423/243.08; 208/206

[56] References Cited

U.S. PATENT DOCUMENTS 4,020,144 4/1977 Bosniack ..... 423/243.2
4,049,572 9/1977 Douglas ..... 502/163

*Primary Examiner*—Gregory A. Heller

*Attorney, Agent, or Firm*—Thomas K. McBride; John G. Tolomei

[57] ABSTRACT

Fuel gas streams containing oxygen are treated by a process that performs simultaneous sweetening and absorption of mercaptan compounds. The mercaptan oxidation catalyst and an aqueous alkaline solution and a low vapor pressure liquid hydrocarbon stream contact the fuel gas feed in a mixing vessel to sweeten the mercaptans and absorb resulting disulfides from the gas stream into the liquid hydrocarbon stream. A separation vessel receives the dual phase effluent from the mixing vessel and settles the effluent into three component phases. An upper gas phase provides a treated fuel gas stream, an intermediate hydrocarbon phase provides liquid hydrocarbons containing disulfides for removal from the process, and recycle to the mixing vessel and an alkaline solution drains from the bottom of the settler. The aqueous alkaline solution is pumped back to the mixing vessel in combination with the mercaptan oxidation catalyst.

14 Claims, 1 Drawing Sheet

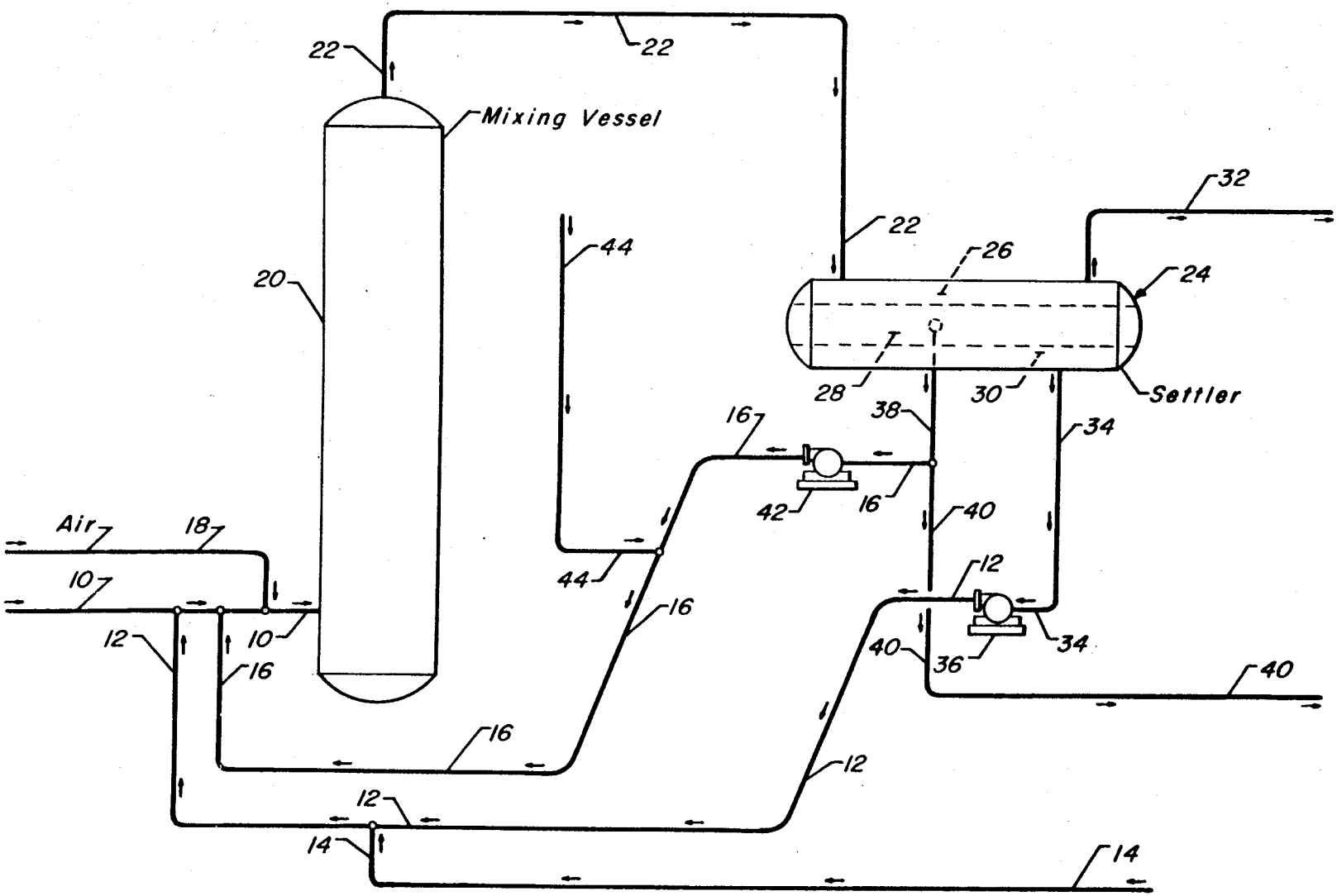
Settler
Mixing Vessel
Air
10
12
14
16
18
20
22
24
26
28
30
32
34
36
38
40
42
44

TREATMENT OF OXYGEN CONTAINING GASEOUS HYDROCARBONS FOR MERCAPTAN REMOVAL

BACKGROUND OF THE INVENTION

1. Field of the Invention

This invention relates generally to processes for the treatment mercaptans. More specifically this invention relates to processes for the removal of mercaptans from normally gaseous hydrocarbons streams.

2. Description of the Prior Art

The sweetening of sour hydrocarbons streams by the conversion or removal of mercaptan sulfur is well known. Mercaptans present in such feedstreams are converted by the sweetening process to disulfide compounds. In the sweetening process the mercaptan containing hydrocarbon contacts a mercaptan oxidation catalyst carried by an alkaline solution in the presence of an oxygen supply stream. Typically in the performance of the sweetening process the disulfides remain in the hydrocarbon stream and are, therefore, not removed but converted to an acceptable form.

A wide variety of processes are known for the sweetening of distillates. U.S. Pat. No. 4,490,246 and the references cited therein set forth a number of flow schemes for the sweetening process. A number of different separation arrangements can be used to recover the treated distillate and the catalyst containing alkaline stream. The '246 patent seeks to reduce the separation of dissolved disulfide gases from a liquid product and teaches the use of a settler and a low pressure separator to remove a gaseous phase of disulfides from the product effluent of the sweetening process. As demonstrated by U.S. Pat. No. 2,988,500 a single settler can be used to withdraw excess gases overhead, a product stream from an intermediate section of the settler and a bottoms stream of an alkaline catalyst solution.

Extraction processes are typically used when treating light hydrocarbons and gas streams for mercaptan removal. In the extraction process the feed first contacts a caustic solution in an extraction column. The caustic solution contains a mercaptan oxidation catalyst. Feed depleted in mercaptans passes overhead from the extraction column and the mercaptan containing caustic passes countercurrently from the bottom of the column. The mercaptan rich caustic receives an injection of air and catalyst as it passes from the extraction column to an oxidizer for the conversion of mercaptans to disulfides. A disufide settler receives the disulfide rich caustic from the oxidizer. The disulfide settler vents excess air and decants disulfides from the caustic before the caustic is returned to the extractor.

The above described extraction flow scheme can be used to remove mercaptans from fuel gas streams in refineries. In such arrangements the feed is contacted under gaseous conditions. However, such schemes have been found to be unsatisfactory in reducing sulfur concentrations to very low levels when the feed streams have a continuous or intermittent oxygen concentration. The presence of oxygen in the feed leads to oxidation of the mercaptans to disulfides in the extractor. These disulfides are stripped from the caustic by the volatile fuel gas and raise the total sulfur concentration of the fuel gas product to unacceptable levels for environmental standards.

Other methods are known to reduce the sulfur concentration of mercaptan containing gas streams. U.S. Pat. No. 4,808,341 issued Feb. 28, 1989 discloses a process for the separation of gases from mercaptans, the process uses a lean oil to absorb mercaptans in a first contacting zone and regenerates the absorption oil by contacting the mercaptan rich oil with an aqueous oxidizing agent to produce a sulfuric acid solution and a hydrocarbon absorption oil.

SUMMARY OF THE INVENTION

Accordingly, it is an object of this invention to provide an extraction process for the treatment of mercaptan containing gas streams that have a continuous or intermittent oxygen concentration.

It is a further object of this invention to provide a process that uses an aqueous alkaline catalyst solution to extract mercaptans from a mercaptan and oxygen-containing gas stream.

This invention provides a process that removes mercaptans from an oxygen-containing gas stream without sulfur contamination of the gas product or the regeneration of an absorbent stream. The process of this invention removes mercaptans from the gas stream by converting them to disulfides in the presence of an aqueous alkaline solution containing a mercaptan oxidation catalyst and a liquid hydrocarbon stream that acts as a disulfide acceptor. By using the liquid hydrocarbon stream in the mixing zone, the mercaptans in the gas stream can be converted to disulfides and absorbed into a liquid phase without contaminating the gas stream product. The gaseous stream, the alkaline solution and the liquid hydrocarbon stream enter a settler that separates the gaseous product, the liquid hydrocarbon stream and the catalyst containing alkaline solution. The use of a single settler and a liquid hydrocarbon stream as a disulfide acceptor provides a simple process arrangement for the production of a very low sulfur gas stream.

Accordingly in one embodiment, this invention is a process for desulfurizing a gaseous feedstock containing mercaptans, hydrocarbons and oxygen. The process comprises mixing the gaseous feedstock, a low vapor pressure liquid hydrocarbon stream and an aqueous alkaline solution containing a mercaptan oxidation catalyst in a mixing vessel to convert the mercaptans to disulfides and absorb disulfides in the liquid hydrocarbon stream. The mixture of the feedstock, the aqueous alkaline solution, the oxidation catalyst and the disulfide containing liquid hydrocarbon stream are passed to a settler vessel. An upper gaseous phase, an intermediate liquid hydrocarbon phase and a lower aqueous phase are maintained in the settler vessel. A gaseous phase containing hydrocarbons and having a reduced concentration of mercaptans relative to the gaseous feedstock is withdrawn from the upper phase of the settler vessel. A disulfide containing liquid hydrocarbon is withdrawn from an intermediate phase of the settler vessel and removed from the process. The aqueous alkaline solution is withdrawn from the lower phase and returned to the mixing vessel.

In a more specific embodiment, this invention is a process for desulfurizing a gaseous feedstock that contains mercaptans, hydrocarbons and oxygen. The process includes the steps of admixing the gaseous feedstock, a naphtha boiling range hydrocarbon stream and an aqueous alkaline solution containing a mercaptan oxidation catalyst. The admixture is passed to a mixing vessel at conditions to maintain the naphtha stream in liquid phase, to convert the mercaptans to the disulfides and absorb disulfides in the naphtha. An oxygen concentration of at least 20 vol. % more than the theoretical mercaptan demand is maintained in the mixing vessel. A mixing vessel effluent comprising the feedstock, the aqueous alkaline solution, oxidation catalyst and a disulfide containing naphtha stream are passed to a settler vessel. An upper gaseous phase, an intermediate liquid naphtha phase, and a lower aqueous phase is maintained in the settler vessel. A gaseous hydrocarbon stream having a total sulfur concentration of less than 40 mol ppm is withdrawn from the gaseous phase of the settler vessel. Naphtha from the intermediate naphtha phase is withdrawn from the settler vessel and removed from the process. The aqueous alkaline solution is removed from the lower phase of the settler vessel and returned for admixture with the feedstock and naphtha stream.

Other objects, embodiments and details of this invention are disclosed in the following detailed description of the invention.

BRIEF DESCRIPTION OF THE DRAWING

The FIGURE shows a schematic representation of a process flowscheme for practicing the process of this invention.

A general understanding of the process of this invention can be obtained by reference to the drawing. The drawing has been simplified by the deletion of a large number of apparatus customarily employed in a process of this nature such as vessel internals, temperature and pressure control systems, flow control valves, recycle pumps, etc. which are not specifically required to illustrate the performance of the subject process. Furthermore, the illustration of the process of this invention in the embodiment of a specific drawing is not intended to limit the invention or preclude other embodiments set out herein, or reasonably expected modifications thereof. Referring then to the drawing, a hydrocarbonaceous gas stream containing mercaptan sulfur and possibly oxygen enters the process through line 10. A line 12 carries an aqueous alkaline stream that contains a mercaptan oxidation catalyst which is introduced into line 12 by a catalyst addition line 14. A line 16 carries a relatively low vapor pressure hydrocarbon stream. The contents of lines 12 and 16 along with air from a line 18 pass into admixture with the contents of line 10 and are charged to a mixing vessel 20. After sufficient contacting and residence time in vessel 20 to convert mercaptans in the feedstream to disulfides, a line 22 carries the mixture of gaseous feed, a disulfide containing liquid hydrocarbon stream, and the aqueous soltuion of mercaptan oxidation catalyst into a settle vessel 24. Quiescent conditions are maintained in the settler vessel to establish an upper gaseous phase 26, an intermediate liquid hydrocarbon phase 28 and an aqueous phase 30. The treated gas stream having a low concentration of mercaptan and disulfide sulfur is withdrawn from the gaseous phase by a line 32 and recovered as a product. The aqueous phase containing the alkaline contacting medium is withdrawn from the bottom of the settler vessel by a line 34 and pressured by pump 36 back into contact with the gaseous feed via line 12. The low pressure liquid hydrocarbon phase now containing an increased concentration of disulfides is withdrawn from phase 28 by a line 38. A portion of the liquid hydrocarbon phase is withdrawn from the process by a line 40 for use as an intermediate or product in other processes, a pump 42 circulates the remaining portion of the liquid hydrocarbons from line 38 back into contact with the gaseous feed by a line 16. Additional amounts of low vapor pressure liquid hydrocarbons are added to line 16 by a line 44. Fresh caustic and spent caustic are added as make up or withdrawn from the unit batchwise via line 33.

DETAILED DESCRIPTION OF THE INVENTION

This invention is used to remove mercaptan sulfur and any derivative sulfur compounds from gaseous feedstocks. These feedstocks will be primarily composed of $C_4$ and lower carbon number hydrocarbons. In most instances, suitable feedstreams will comprise $C_3$ and lighter hydrocarbons. In particular, the feedstreams will primarily compose fuel gas streams having a gross heating value of more than 300 BTU per standard cubic feet. Feedstreams of this type will often be subject to environmental regulations for a reduction in the total amount of sulfur emitted by the combustion of such fuel gas streams. This invention will be used to reduce the sulfur in the gaseous product stream to a range of from 10 to 100 mol ppm and more preferably to below 40 mol ppm sulfur calculated as $H_2S$. It is anticipated that refinery flare gas streams, refinery product off gas streams, tank vapor recovery systems, and other typical refinery fuel gas sources will provide the primary source of the gaseous feedstock when practicing this invention. Another characteristic of suitable feedstocks for this invention is that they contain oxygen in an amount of from 0 to 5 vol. % on a continuous or intermittent basis. It is the presence of this oxygen that makes other mercaptan extraction systems unsuitable for treating such feedstocks and provides the operational benefits of this invention.

The feedstocks will also contain mercaptans. The relatively lighter mercaptans contained in the gaseous feedstock can be readily converted to disulfides by the sweetening reaction of this invention. The sweetening reaction is promoted in the usual manner by the contact of the mercaptans with an aqueous alkali solution in which the mercaptans are soluble. The alkaline solution can comprise any alkaline hydroxide but is preferably sodium hydroxide in a concentration of from 1 to 25 wt %. The aqueous alkaline solution will usually be added to the unit in an amount equal to 1 to 25 wt. % of NaOH and preferably 5 to 10 wt. % of NaOH.

As in most sweetening operations, the aqueous alkaline solution will also contain a mercaptan oxidation catalyst. This invention does not require the use of a specific mercaptan oxidation catalyst. Many suitable catalysts are known in the art. One preferred class of catalysts comprise a sulfonated metal phthalocyanine. A particularly preferred sulfonated metal phthalocyanine is a highly monosulfonated cobalt phthalocyanine prepared by the method of U.S. Pat. No. 4,049,572, the teachings of which are herein incorporated by reference. Other phthalocyanine catalysts are described in U.S. Pat. No. 4,897,180. Additional dipolar type catalyst that are suitable for use in an alkaline contacting solution are described in U.S. Pat. Nos. 4,956,324; 3,923,645; 3,980,582 and 4,090,954. Usually a relatively small concentration of oxidation catalyst is required in the aqueous alkaline solution. Any method can be used to add the oxidation catalyst to the aqueous alkaline solution including such devices as a blow case or an injection pump. Typically, the oxidation catalyst in the aqueous alkaline solution will have a concentration of from 10 to 500 wt. ppm and preferably a concentration of 200 wt. ppm.

Sweetening of the mercaptans in the mixing vessel is done in the presence of a relatively low vapor pressure liquid hydrocarbon stream that can act as a disulfide acceptor. The disulfides must be removed from the normally gaseous phase portion of the treating admixture in order to reduce the final sulfur concentration of the product. The liquid hydrocarbon stream will function as an absorbent to retain the disulfides that are produced from the sweetening of the mercaptans. The liquid hydrocarbon stream must be present in a sufficient concentration and with a sufficiently low disulfide partial pressure in order to prevent the volatilization of disulfides into the product gas stream. In order to prevent volatilization of mercaptans, the liquid hydrocarbon stream will comprise $C_5$ and higher hydrocarbon fractions having boiling points of at least 100° F. or more. More preferably, the streams will comprise 200°–400° F. boiling range hydrotreated naphthas. Reforming and alkylate product streams are also preferred. When using a typical naphtha stream as the liquid hydrocarbon, the aqueous alkaline solution to the naphtha can usually range from 100:1 to 1:100 and preferably will be in a ratio of from 5:1 to 10:1. Suitable liquid hydrocarbon streams will also be streams that can readily accept disulfides without deterioration of the value or utility of such streams. For most refiners, low vapor pressure liquid hydrocarbon products will be available in sufficient quantity and with allowable product specifications for disulfide concentration to meet the disulfide adsorption requirements of this invention.

While this invention is particularly suited to treating oxygen-containing gaseous hydrocarbon streams, in some cases the oxygen concentration of such streams will be insufficient to completely convert all mercaptans to disulfides. In order to allow a complete regeneration of mercaptans from the aqueous alkaline solution, an additional amount of oxygen-containing gas may be required as a reactant. The oxygen-containing gas may be added at any point where it can react with soluble mercaptans in the aqueous alkaline stream. Preferably any needed oxygen-containing gas, typically air, will be added to the mixture of gaseous feed, aqueous alkaline solution and liquid hydrocarbons.

Complete conversion of mercaptans to disulfide and absorption of disulfides into the normally liquid hydrocarbon stream is assured by contact of feedstock and feed inputs in a mixing zone. The mixing zone would normally comprise a vertical contacting vessel. The aqueous alkaline stream and the liquid hydrocarbon streams would normally flow upwardly through the vessel, but downward flow may be preferable in some cases. The mixing vessel is designed to provide sufficient residence time and contacting of the reactants and absorbents to provide the necessary conversion of mercaptans and removal of disulfides from the normally gaseous components. A broad range of operating conditions can be used to promote the sweetening reaction in the mixing vessel. Typically, these conditions will include a temperature of from 50°–150° F. and a pressure of from 2 to 2000 psig. Those skilled in the art are aware of a variety of such mixing devices that can be used to provide contact and residence time for the sweetening reaction to occur. Suitable devices for this invention would include orifice plate columns, trayed contactors, packed contactors or fiber film contactors as described in U.S. Pat. No. 3,754,377. Although the drawing shows the process operating with a concurrent flow of gaseous and liquid phase components, the invention can also be practiced with countercurrent flow of the liquid components to the gaseous feedstock.

A separation zone receives a product containing mixture from the mixing vessel. The mixture comprises the catalyst containing alkaline solution, a liquid hydrocarbon stream, and the product gases. In this invention the separation zone provides a three-phase settling operation which separates the product gases, liquid hydrocarbon, and catalyst containing alkaline solution into three distinct phases. For the purposes of this description, the term "phase" refers to the different physical states of the gas and liquid portions as well as the different immiscible components of the liquid portion. The settler vessel is arranged with appropriate baffling to provide quiescent conditions that will allow a stable formation of the three phases. The settler vessel is preferentially arranged horizontally and operates at a pressure and temperature similar to that in the mixing vessel. Product gases form the uppermost phase in the settler vessel. A product line at the top of the vessel withdraws the product gases. Below the uppermost gas phase, the liquid hydrocarbon stream forms an intermediate phase. An inlet located in a mid portion of the settler vessel withdraws the liquid hydrocarbon from an intermediate point of the settler vessel. The alkaline solution fills the bottom portion of the settler vessel with an aqueous phase that drains from the vessel. Regulation of the withdrawal rates for the three output streams from the settler vessel in conjunction with monitoring of the different phase levels maintains the intermediate phase within definite vertical limits to assure the continuous availability of all three streams from the settler vessel.

A portion of the liquid hydrocarbon withdrawn from the intermediate phase of the settler vessel usually leaves the process. Usually some proportion of the liquid phase returns as a recycle to the inlet of the mixing vessel. An influx of additional liquid hydrocarbons replaces the liquid hydrocarbons withdrawn from the process and keeps the disulfide partial pressure in the circulating liquid hydrocarbon stream at a desired level. The removal and replacement of the liquid hydrocarbon stream from the process provides a primary mechanism for controlling the disulfide concentration of the product stream. Thus, the relative proportion of recycled liquid hydrocarbon will vary with the disulfide concentration of the liquid hydrocarbon stream entering the process and the amount of mercaptans to be removed from the feed gas. Therefore, the amount of liquid hydrocarbon recycled to the process can vary with any wide range of limits depending on the liquid hydrocarbon and the gaseous feedstock. However, for a typical naphtha stream and fuel gas feed from 5 to 95 vol. % of the liquid hydrocarbons will return as a recycle.

EXAMPLE

In order to further demonstrate a typical operation of this process, the following example shows the process of this invention treating a gaseous feedstock having the composition described in the Table. This example is further described with reference to the specific flowscheme shown in the Figure. This example has been generated from a computer simulation of the process of this invention using correlations and data from experimental results and actual operating units.

In the mixing operation, an air stream in an amount of 700 standard cubic feet per hour, a 1.85 molar NaOH solution containing 200 wt. ppm of a cobalt phthalocyanine catalyst and a recirculating naphtha stream in an amount of 14 gallons per minute combined with 6300 standard cubic feet per minute of the gaseous feedstock enter the mixing vessel. The mixing vessel operates at a temperature of 100° F. and a pressure of 100 psia. After an average residence time of about 2 minutes, the triple phase effluent from the mixing vessel flows into a settler vessel.

The settler vessel separates the mixed phase effluent into the three components previously described. Caustic removed from the bottom of the settler vessel returns for admixture with the feed. Periodically, an additional amount of fresh caustic containing approximately 200 wt. ppm of the oxidation catalyst is added to the recycle stream. Approximately, 50 vol. % of the naphtha removed from the settler vessel leaves the process. Fresh hydrotreated naphtha having a boiling point of 300°-500° F. replaces all of the naphtha that exits the process and flows in combination with the remainder of the naphtha from the settler vessel into admixture with the gas feed. A product gas stream having the composition given in the table flows out of the top of the settler vessel.

As demonstrated by this example, the process of this invention reduces the mercaptan and disulfide concentration of the gaseous feed to very low levels. This reduction of sulfur compounds uses very little processing equipment and a relatively simple process scheme. The simple flowscheme and process operation makes this invention particularly useful in meeting the sulfur removal requirements of oxygen-containing fuel gas streams.

TABLE

| Component | Feed Gas Mol % | Product Gas Mol % (ppm) |
|---|---|---|
| Hydrogen | 28.00 | 28.02 |
| Methane | 28.00 | 27.96 |
| Nitrogen | 5.00 | 4.99 |
| Oxygen | 0.08 | 0.08 |
| Ethane | 22.92 | 22.84 |
| Propane | 10.00 | 9.90 |
| Isobutane | 5.96 | 5.80 |
| Mercaptans | 0.04 | (5) |
| Disulfides | — | (13) |
| Naphtha | — | 0.41 |
| | 100.00 | 100.00 |

What is claimed is:

1. A process for desulfurizing a gaseous hydrocarbonaceous feedstock containing mercaptans and oxygen, said process comprising;
   (a) mixing said gaseous feedstock, a low vapor pressure liquid hydrocarbon stream, and an aqueous alkaline solution containing a mercaptan oxidation catalyst in a mixing vessel to convert said mercaptans to disulfides and absorb disulfides in said liquid hydrocarbon stream;
   (b) passing a mixture of said feedstock, the aqueous alkaline solution, oxidation catalyst and a disulfide containing liquid hydrocarbon stream to a settler vessel;
   (c) maintaining an upper gaseous phase, an intermediate liquid hydrocarbon phase and a lower aqueous phase in said settler vessel;
   (d) withdrawing a gaseous phase containing hydrocarbons and having a reduced concentration of mercaptans relative to said gaseous feedstock from said upper phase;
   (e) withdrawing said disulfide containing liquid hydrocarbon from said intermediate phase and removing it from the process; and
   (f) withdrawing said aqueous alkaline solution from said lower phase and returning said aqueous alkaline solution to said mixing of step (a).

2. The process of claim 1 wherein said gaseous feedstock comprises refinery flare gas or product tank recovery gas.

3. The process of claim 1 wherein said liquid hydrocarbon stream is a naphtha stream.

4. The process of claim 1 wherein said liquid hydrocarbon stream is a reforming product stream, an alkylate product stream, or a hydrotreated naphtha.

5. The process of claim 1 wherein said aqueous alkaline solution comprises a 1 to 25 wt. % sodium hydroxide solution.

6. The process of claim 1 wherein said mercaptan oxidation catalyst comprises a sulfonated derivative of a metal phthalocyanine compound.

7. The process of claim 6 wherein said phthalocyanine compound substantially comprises a disulfonated derivative.

8. The process of claim 1 wherein said mixing vessel has an inventory of from 5 to 50 vol. % of said aqueous alkaline solution.

9. The process of claim 1 wherein the ratio of aqueous alkaline solution to said liquid hydrocarbon stream is in a range of from 100:1 to 1:100.

10. A process for desulfurizing a gaseous feedstock containing mercaptans, hydrocarbons and oxygen, said process comprising;
   (a) admixing said gaseous feedstock, a naphtha boiling range hydrocarbon stream, and an aqueous alkaline solution containing a mercaptan oxidation catalyst;
   (b) passing said admixture to a mixing vessel at conditions to maintain said naphtha stream in liquid phase, to convert said mercaptans to disulfides, and to absorb disulfides in said naphtha;
   (c) maintaining an oxygen free concentration of at least 10 mol ppm in said mixing vessel;
   (d) passing a mixing vessel effluent comprising said feedstock, the aqueous alkaline solution, oxidation catalyst, and a disulfide containing naphtha stream to a settler vessel;
   (e) maintaining an upper gaseous phase, an intermediate liquid naphtha phase, and a lower aqueous phase in said settler vessel;
   (f) withdrawing a gaseous hydrocarbon phase having a total sulfur concentration of less than 100 mol ppm.;
   (g) withdrawing naphtha from said intermediate naphtha phase and removing it from the process; and
   (h) withdrawing said aqueous alkaline solution from said lower phase and returning said aqueous alkaline solution to said mixing of step (a).

11. The process of claim 10 wherein said mixing vessel operates at a temperature in the range of from 50°-150° F. and a pressure of from 2 to 50 psig.

12. The process of claim 10 wherein said mercaptan oxidation catalyst comprises a cobalt phthalocyanine disulfonate.

13. The process of claim 10 wherein said aqueous alkaline solution comprises a sodium hydroxide solution and said mixing vessel has an inventory of 5 to 10 vol. % of said solution.

14. The process of claim 13 wherein the ratio of said sodium hydroxide solution to naphtha in said mixing vessel is from 5:1 to 10:1.

* * * * *